US005232523A

United States Patent [19]

Endo et al.

[11] Patent Number: 5,232,523

[45] Date of Patent: Aug. 3, 1993

[54] PHOSPHATE COATINGS FOR METAL SURFACES

[75] Inventors: Koetsu Endo, Kyoto; Akio Tokuyama; Tamotsu Sobata, both of Osaka, all of Japan

[73] Assignee: Nippon Paint Co., Ltd.

[21] Appl. No.: 879,724

[22] Filed: May 6, 1992

Related U.S. Application Data

[63] Continuation of Ser. No. 487,247, Mar. 2, 1990, abandoned.

[30] Foreign Application Priority Data

Mar. 2, 1989 [JP] Japan ..... 1-50567

[51] Int. Cl.[5] ..... C23C 22/12

[52] U.S. Cl. ..... 148/251; 148/262; 148/260

[58] Field of Search ..... 148/251, 260, 262

[56] References Cited

U.S. PATENT DOCUMENTS 4,264,378 4/1981 Oppen ..... 148/262

*Primary Examiner*—Sam Silverberg

*Attorney, Agent, or Firm*—Wenderoth, Lind & Ponack

[57] ABSTRACT

The present inventin concerns a process for phosphating a metal surface comprising treating a metal surface with an acidic aqueous phosphate solution comprising zinc ion, phosphate ion, a phosphating accelerator and particular concentration of colloidal particles having an isoelectric point of 3 or less and an average particle diameter of 0.1μ or less, the metal surface being iron-based surface, zinc-based surface or combination thereof and the resulted phosphate coating being excellent in film adhesion, corrosion resistance and especially scab corrosion resistance.

6 Claims, No Drawings

PHOSPHATE COATINGS FOR METAL SURFACES

This application is a continuation of now abandoned application, Ser. No. 07/487,247, filed Mar. 2, 1990, abandoned.

The present invention relates to a process for phosphating a metal surface to be coated with a coating composition. More particularly, it relates to a process for forming a phosphate film on a metal surface, which is specifically suitable for cationic electro-coating and is excellent in film adhesion, corrosion resistance and especially hot brine resistance, and scab corrosion resistance.

BACKGROUND OF THE INVENTION

As a metal pre-treatment, has long been adopted a phosphating in which an acidic aqueous phosphate solution is applied on a metal surface by spraying, dipping or combination thereof.

Though a spraying process has the advantage of diminished installation cost and excellent production efficiency, there are such problems that when a metal substrate has the complicated structure, there often results a coating with many un-phosphated portions and phosphating failure due to spray splash. Whereas, in the so-called dipping process, an installation cost is indeed undesirably increased, but there includes no such problems as abovementioned, resulting a uniform phosphate coating.

However, in the heretofore proposed phosphate coating by dipping the desired phosphating is only obtained by treating a metal with a phosphate solution containing a higher concentration, i.e. about 2 to 4 g/l, of zinc ion, at a higher temperature (60° to 90° C.) for a comparatively longer duration of time (3~10 minutes), and further more, thus obtained coating, having a comparatively high coating weight (3~5 g/m$^2$) and bad quality, is believed to be unsuitable as a base coat and especially a base coat for electrodeposition coating because of its poor adhesion , corrosion resistance, coating appearance or the like.

Recently, with the increasing demands of such products as having improved anticorrosive nature, in much severe corrosive atmosphere in an automobile industry and the like, public attentions are rather directed to cationic electrodeposition coatings than anionic type electrodeposition coatings.

However, at the baking stage, marked shrinkage of thus applied coating is always occurred, which in turn will produce a big energy to the phosphating coating.

Therefore, it is essential that the phosphating coating for cationic electrodeposition should have an increased strength as a matter of course.

Nevertheless, heretofore proposed phosphating coatings by dipping have failed to obtain the coatings for electrodeposition coating and especially cationic electrodeposition coating.

Under the circumstances, a novel technique has been proposed in Japanese Patent Publication (unexamined) No. 107784/80, in which a metal surface is treated by dipping means with an acidic aqueous phosphate solution containing controlled amounts of zinc ion, phosphate ion and phosphating accelerator as nitrite ion, at a lower temperature for a short period of time, obtaining a uniform dense phosphating coating having a comparatively low coating weight, being excellent in adhesion and anticorrosion properties and being specifically useful as an under coat for electrodeposition coating.

Since then, such a dipping method has again moved into the limelight in the related technical fields.

In the abovementioned Japanese Patent Publication, a metal surface is first treated by dipping with an acidic aqueous phosphate solution containing from 0.5 to 1.5 g/l of zinc ion, from 5 to 30 g/l of phosphate ion, and from 0.01 to 0.2 g/l nitrite ion as main ingredients, at 40°~70° C. for 15 to 120 seconds and then treated, for the purpose of removing the remained sludge, by spraying with the same phosphate solution at 40°~70° C. for 2 to 60 seconds, to obtain a uniform and dense phosphate film with a low coating weight of 1.5~3 g/m$^2$, which is useful as an under coat for electrodeposition coating. This technique is very useful for the treatment of iron-based surface and however, is not for the treatment of zinc-based surface because of resulting a phosphate coating having inferior secondary adhesion for intermediate and top coats and brine-spraying resistance of the electrodeposited coating. Further more, in a recent development in the automobile industry, there has come to be used for can bodies steel components plated on one surface with zinc or alloyed zinc, and a far improved phosphating process applicable to not only iron-based surface, but also to a zinc-based surface or a metal surface including both iron-based and zinc-based surfaces has been a pressing need.

To cope with the same, have been offered a technique in Japanese Patent Publication (unexamined) No. 152472/82 of using an acidic aqueous phosphate solution comprising controlled amounts of zinc ion, phosphate ion and phosphating accelerator, added with from 0.6 to 3 g/l of manganese ion and/or from 0.1 to 4 g/l of nickel ion, or a technique in Japanese Patent Publication No. 36588/86 of using an acidic aqueous phosphate solution comprising zinc ion, phosphate ion, phosphating accelerator and manganese ion, as will as from 0.05 g/l or more of fluoride ion. These prior art process are reported to be capable of providing excellent adhesion and corrosion resistance to the coating for electrodeposition coating.

In a recent automobile industry, a much higher degree of anti-corrosion property is required on the coated metal substrate, as, for example, excellent scab corrosion resistance (i.e. resistance to the formation of scabby rusts formed on iron-based surface when injured coating is repeatedly subjected to brine or dry-wet climetical changes), and hot brine resistance and the like.

Nevertheless, very unfortunately, no good solution has been found out in having a higher degree of scab corrosion resistance and hot brine resistance as desired.

In other technical field of home appliances, steel had once been the major substrate, which had been customarily phosphated by spraying treatment. Even it that area, galvanized steel is increasing a share of the substrate material, because of its excellent corrosion resistance. Therefore, further improvements in adhesion, corrosion resistance, scab resistance and hot brine resistance of the coated metal are likewise required.

It is, therefore, an object of the invention to provide a process for forming a phosphate film on both iron-based surface and a metal surface including iron-based surface and zinc-based surface.

Another object of the invention is to provide a process for forming a phosphate film which is suitable for coating and especially electrodeposition coating.

A further object of the invention is to provide a process for forming a phosphate film which is excellent in scab resistance when applied on iron-based surface, excellent in hot brine resistance when applied on iron-based surface or zinc-based surface, and is excellent in secondary adhesion when applied with an intermediate or top coat thereupon.

Other objects and advantages of the present invention will become apparent from the following disclosure.

According to the present invention, the abovementioned and other objects can be attained with a process for phosphating a metal surface with an acidic aqueous phosphate solution containing 0.01 to 10 g/l of colloidal particles having an isoelectric point of 3 or less and an average particle diameter of 0.1μ or less.

The invention had been made on the basis of our novel finding that the desired effects of such colloidal particles are fully attained when zinc ion, nickel ion, manganese ion and fluoride ion are present each in defined concentration range in an acidic aqueous phosphate solution.

The advantage of the present invention is most prominently exhibited when the treatment is carried out on metal surfaces which include both an iron-based surface and a zinc-based surface, or an iron-based surface alone. However, it is likewise useful for a zinc-based surface, and thus, the present process in widely applicable to various metal surfaces, including galvanized steel plate, galvanealed steel plate, electro galvanized steel plate, electro zinc-alloy plated steel plate, complex electro galvanized steel plate and the like.

In an actual operation, a metal surface is first subjected to a spray treatment and/or a dip treatment with an alkaline degreasing agent at 20°~60° C. for about 2 minutes and washed with tap-water. Then, in the case of dip treatment, the washed metal is treated with a surface conditioner by spraying and/or dipping in the surface conditioner solution at a room temperature for 10~30 seconds, and subsequently, thus treated metal is subjected to the present process, i.e. treating the metal surface with the present acidic aqueous phosphate solution at 20°~70° C. for 15 seconds or more, by dipping and/or spraying means, and finally washed with tap-water and then with a deionized water.

When the present process is carried out by dip treatment, the zinc ion concentration in the present phosphate solution should be in a range of 0.1 to 2.0 g/l and more preferably 0.3 to 1.5 g/l. If the zinc ion content in said acidic phosphate solution is less than 0.1 g/l, an even phosphate film cannot be formed on the iron-based surfaces, resulting an uneven, partly blue-colored film.

When the zinc ion content exceeds over 2.0 g/l, there indeed results an even phosphate film but since the formed film is liable to be easily dissolved in an alkaline solution and especially in an alkaline atmosphere exposed at the time of cationic electrodeposition, it is unable to use the phosphated substrate for electrodeposition coating and especially for cationic electrodeposition coating. At that time, there is an undesired decrease in hot brine resistance in general, and scab resistance in the case of iron-based surface.

The content of phosphate ion in the present acidic phosphate solution should be limited in a range of 5 to 40 g/l, and preferably 10 to 30 g/l. When the content of phosphate ion in the above solution is less than 5 g/l, an uneven phosphate film is at to be formed. When the phosphate content is more than 40 g/l, no further benefits result, and it is therefore economically disadvantageous to use additional quantities of phosphate chemicals.

In the present phosphate solution, the content of colloidal particles having an isoelectric point of 3 or less and an average particle diameter of 0.1μ or less should be selected in a range of 0.01 to 10 g/l, preferably 0.05 to 5 g/l. When the content of such colloidal particles in the phosphate solution is less than 0.01 g/l, it is unable to get the desired modification of phosphate film in full, and if the content of such colloidal particles is more than 10 g/l, the desired effects tend to be lowered and hence such an excess amount is not desired.

Average diameter of such particles should be in a range of 0.001μ to 0.1μ, the lower limit being the minimum diameter for colloidal dispersion and the upper limit being fixed for the intended objects and effects of improvements in scab resistance, hot brine resistance and the like. The isolectric point of such particles is one of the characteristics showing an electrification tendency of the particles, and electrification may vary with pH of the aqueous dispersion of said particles. For example, in the case of particles with an isoelectric point of 3, said particles do electrified in neither positive nor negative in an aqueous dispersion having pH=3, electrified in positive in an aqueous dispersion of pH<3 and in negative in an aqueous dispersion of pH>3.

Since the pH of the present acidic aqueous phosphate solution is within a range of 3~4, the colloidal particles used in the present invention are acidic particles capable of being electrified in negative in an acidic aqueous phosphate solution.

When the colloidal particles having an isoelectric point of more than 3 are used in the present phosphate solution, these particles are aggregated, resulting sludges, and the intended objects of modification of phosphate film can not be attained therewith.

As a phosphating accelerator, one or more of the following may be advantageously used:

(i) from 0.01 to 0.5 g/l, preferably 0.01 to 0.4 g/l, of nitrite ion, (ii) from 0.05 to 5 g/l, preferably 0.1 to 4 g/l, of m-nitrobenzene sulfonate, and (iii) from 0.5 to 10 g/l, preferably 1 to 8 g/l of hydrogen peroxide (based on 100% $H_2O_2$)

When the content of phosphating accelerator is less than the defined amounts, it is unable to get a fully satisfiable phosphate film on an iron-based surface, often resulting yellow rusts, and when the content of phosphating accelerator exceeds over the upper limit, there is a tendency that uneven, blue-colored phosphate film be formed on an iron-based surface.

As the sources of the ingredients of the present phosphate solution, the following may be satisfactorily used; as the zinc ion sources, zinc oxide, zinc carbonate, zinc nitrate and the like; as the phosphate ion sources, phosphoric acid, zinc phosphate, manganese phosphate and the like.

As the colloidal particles, one or more than 2 of the following may be advantageously used: Silica particles (e.g. Snow Tex O, trademark, Nissan Kagaku Kogyo K.K., particle diameter 10~20 mμ, isoelectric point 2); Silica alumina particles (e.g. Snow Tex AK, trademark, Nissan Kagaku Kogyo K.K., average diameter 10~20 mμ, isoelectric point 3 or less); Silica-Titania particles (e.g. Ceramica U-1000, trademark, Nichiban Kenkyusha, isoelectric point 3 or less); Silica-Zirconia particles (e.g. Ceramica G-1500, trademark, Nichiban Kenkyusha, isoelectric point 3 or less); antimony oxide (e.g.

A-1550, trademark Nissan Kagaku Kogyo K.K., average diameter 20~50 mμ, isoelectric point 3 or less); and acrylic resin particles prepared by the method of Japanese Patent Publication No. 43362/61.

As the phosphating accelerator, the following may be used; sodium nitrite, ammonium nitrite, sodium m-nitrobenzene sulfonate, hydrogen peroxide and the like.

In a spray treatment, in order to improve phosphating efficiency, cut down the amount of nitrite to one half or less as compared with those of the conventional phosphate solutions and decrease the amount of by-produced sludge to one third to one fourth, an improved phosphate solution had been proposed in Japanese Patent Publication N. 5590/80, the solution comprising at least 5 g/l of phosphate ion, 0.02 to 0.5 g/l of nitrite ion, at least 0.3 g/l of zinc ion, the molar weight ratio of phosphate ion to nitrite ion being 1:0.7~1:1.3, the molar weight ratio of phosphate ion to zinc ion being 1:0.116 or less and pH of the solution being 3.3~3.8.

Even for the disclosed phosphate solution, as well as other acidic aqueous phosphate solutions for spray use, it is likewise able to improve scab resistance, hot brine resistance, adhesion and especially adhesion in the case of zinc-based surface, of the phosphated metal surfaces by including, according to the invention, 0.01 to 10 g/l of colloidal particles having an isoelectric point of 3 or less and an average particle diameter of 0.1μ or less.

In the present phosphate solution, besides the abovementioned essential ingredients, one may add particular concentrations of manganese ion, nickel ion and fluorine ion, thereby expecting the synergistic effects with the abovementioned colloidal particles.

The content of manganese ion is preferably in a range of 0.1 to 3 g/l, and most preferably 0.6 to 3 g/l. When the content of manganese ion in the present phosphate solution is less than 0.1 g/l, it is unable to expect the synergistic effects of improvements in adhesion and hot brine resistance in the case of zinc-based surface, with those of colloidal particles having an isoelectric point of 3 or less. When the content of manganese ion exceeds over 3 g/l, then there is a tendency that scab resistance be lowered.

Nickel ion content in the present phosphate solution should preferably be limited in a range of 0.1 to 6 g/l, and most preferably 0.1 to 2 g/l. When the nickel content in the present phosphate solution is less than 0.1 g/l, it is unable to get the synergistic effect of improving scab resistance with the present colloidal particles and when the nickel content is more than 6 g/l, there is an undesirable decrease in hot brine resistance. Fluoride ion content should preferably be in a range of 0.05 to 4 g/l, and most preferably 0.1 to 2 g/l. When the fluoride ion content in the present phosphate solution is less than 0.05 g/l, it is unable to get the desired synergistic effect of improvement in scab resistance with the present colloidal particles and when the fluoride ion content is more than 4 g/l, there is a tendency that the desired hot brine resistance will be lowered. If desired, the present phosphate solution may further contain nitrate ion, chlorate ion and the like.

The nitrate ion content in the present phosphate solution may be in a range of 0.1 to 15 g/l and preferably 2 to 10 g/l, and the chlorate ion concentration is in general in a range of 0.05 to 2.0 g/l and more preferably 0.2 to 1.5 g/l. These components may be added each in singularly or in combination of 2 or more. As the sources of these ingredients, the following may be advantageously used: manganese carbonate, manganese nitrate, manganese chloride, and other manganese sources, and sodium chlorate, ammonium chlorate and other chlorate sources.

In the present process, the treating temperature with the present phosphate solution is in general 20° to 70° C. and preferably 35° to 60° C. If the treating temperature is lower than 20° C., there is an unacceptable increase in the time required to produce an acceptable coating. Conversly, when the treating temperature is too high, the phosphating accelerator is decomposed and excess amounts of precipitated are formed, causing the components in the solution to become unbalanced and making it difficult to obtain satisfactorily phosphate film.

Usually, the present phosphating treatment is effected for at least 15 seconds, preferably for about 30 to 120 seconds. Too short treating time is undesired because of resulting inferior phosphate film. For the treatment of articles having complicated shapes like car bodies, it is preferred to use the combination of dip treatment and spray treatment.

At that time, the substrate to be phosphated is first dipped in the present acidic aqueous phosphate solution for at least 15 seconds, preferably 30 to 120 seconds and then sprayed with the present phosphate solution for at least 2 seconds, preferably 5 to 45 seconds. In this process, it is advantageous to effect the spry treatment for as long a time as is possible within the limitation of the actual production line, so as to remove the sludge adhered on the articles during the dip treatment stage.

Thus, the present phosphating treatment includes any embodiments of dip treatment, spray treatment and combination thereof. Further more, when a metal surface is phosphated according to the present process and subsequently, subjected to a known post-treatment for a phosphating treatment, the desired effects of the present invention can be greatly enhanced. Examples of such post-treatment solutions are aqueous partially reduced chromic acid solution as disclosed in Japanese Patent Publication No. 18217/64 (e.g. Surflite 41, trademark, Nippon Paint Co., Ltd.); aqueous solution containing water soluble zirconium compound and myoinositol phosphoric acid ester as disclosed in Japanese Patent Publication No. 17827/85 (e.g. Surflite 70AN-1, trademark, Nippon Paint Co., Ltd.); and an aqueous solution of polyvinyl phenol derivative as disclosed in Japanese Patent Publication (unexamined) No. 120677/82. Among them, particular preference is given to Surflite 70AN-1.

According to the present invention, it is possible to form on an iron-based surface or a metal surface containing both iron-based surface and zinc-based surface, a phosphate film which is suitable for electrodeposition coating and especially cationic electrodeposition coating and is excellent in corrosion resistance and especially scab resistance, and to form on an iron-based surface, a zinc-based surface or a metal surface including both ion-based surface and zinc-based surface, a phosphate film which is excellent in hot brine resistance and adhesion properties.

The invention shall be now more fully explained in the following Examples.

EXAMPLES 1 TO 4 AND COMPARATIVE EXAMPLES 1 TO 4

(1) metal to be subjected to treatment
(a) galvanealed steel plate
(b) Electro galvanized steel plate
(c) Electro zinc-alloy plated steel plate (d) Cold rolled steel plate (2) Acidic aqueous phosphate solution:

Eight phosphate solutions having the compositions shown in Table 1 were used.

(3) Treating process:

The surfaces of the above 4 kinds of metals were simultaneously treated in accordance with the following processes.

Degreasing → water washing → surface conditioning → phosphating (dip treatment) → water washing → pure water washing → drying → coating (4) Treating condition:

(a) Degreasing:

Using an alkaline degreasing agent ("Surfcleaner SD200" made by Nippon Paint Co., 2 wt % concentration), dip treatment was carried out at 40° C. for 2 minutes.

(b) Washing with water:

Using tap water, washing was carried out at room temperature for 15 seconds.

(c) Surface conditioning:

Using a surface conditioning agent ("Surfline 5N-5" made by Nippon Paint Co., 0.1 wt % concentration), dip treatment was made at room temperature for 15 seconds.

(d) Phosphating:

Using the above acidic aqueous phosphate solution, dip treatment was carried out at 52° C. or 40° C. for 120 seconds.

(e) Water washing:

Using tap water, washing was carried out at room temperature for 15 seconds.

(f) Pure water washing:

Using deionized water, dip treatment was effected at room temperature for 15 seconds.

(g) Drying was carried out with hot blown air at 100° C. for 10 minutes. The appearance of each phosphated plate thus obtained and the weight of the phosphate film were determined.

(h) Coating:

A cationic electro-coating composition ("Power Top U-30 Grey" made by Nippon Paint Co.) was coated to a film thickness of 20μ (voltage 180 V, electricity applying time 3 minutes), and was baked at 180° C. for 30 minutes. A part of thus electro-coated plate was used for the hot brine dipping test.

The remaining non-tested electro-coated plates were then applied with an intermediate coating composition ("Orga TO 4811 Grey", melamine-alkyd resin base composition, made by Nippon Paint Co.) to a film thickness of 30μ by spraying means, baked at 140° C. for 20 minutes, applied with a top coating composition ("Oega TO 630 Dover White", melamine-alkyd resin base composition, made by Nippon Paint Co.) to a film thickness of 40μ by spraying means, and baked at 140° C. for 20 minutes. Thus obtained coated plates by 3-coatings and 3-baking means were then subjected to adhesion test and scab resistance test.

EXAMPLES 5,6 AND COMPARATIVE EXAMPLE 5

(1) Metal to be subjected to treatment:

(a) Galvanealed steel plate (b) Electro galvanized steel plate (c) Electro zinc-alloy plated steel plate (d) Cold rolled steel plate (2) Acidic aqueous phosphate solution: Those having the compositions shown in Table 1 were used.

(3) Treating process:

The surfaces of the above 4 kinds of metals were simultaneously treated in accordance with the following processes:

Degreasing → water washing → phosphating (by spray treatment) → water washing → pure water washing → drying → coating (4) Treating conditions:

(a) Degreasing:

Using an alkaline degreasing agent ("Surfcleaner S102" made by Nippon Paint Co., 2wt % concentration), stray treatment was carried out at 50° C. for 2 minutes.

(b) Washing with water:

Using tap water, washing was carried out at room temperature for 15 seconds.

(c) Phosphating:

Using the above acidic aqueous phosphate solution, spray treatment was carried out at 55° C. for 120 seconds. (pressure 0.7 kg/cm$^2$)

(d) Water washing:

Using tap water, washing was carried out at room temperature for 15 seconds.

(e) Pure water washing:

Using deionized water, dip treatment was effected at room temperature for 15 seconds.

(f) Drying was carried out with hot blown air at 100° C. for 10 minutes. The appearance of each phosphated plate thus obtained and the weight of the phosphate film thereof were determined.

(g) Coating:

A cationic electro-coating composition ("Power TOP U-80 Grey" made by Nippon Paint Co.) was coated to a film thickness for 20μ (voltage 180 V, electricity applying time 3 minutes), and was baked at 180° C. for 30 minutes. A number of each of the resulting electro-coated plates were used for hot brine dip test.

The remaining non-tested electro-coated plates were coated with an intermediate coating composition ("Oega TO 4811 Grey" made by Nippon Paint Co.) to a film thickness of 30 by spraying means, baked at 140° C. for 20 minutes, coated with a top coating composition ("Orga TO 630 Dover White" made by Nippon Paint Co.) to a film thickness of 4μ by spraying means, baked at 140° C. for 20 minutes to obtain coated plates having a total of 3-coatings and 3-bakings, which were then used for the adhesion test and the scab corrosion test.

Test results:

The test results are shown in Table 2. The test methods used are as follows:

(A) hot brine dip test

Cross cuts were made on the electro-coated plate, and thus prepared plate was placed in a 5% aqueous brine maintained at 55° C. for 480 hours. To thus treated plate, an adhesive tape was applied on the cuts and peeled off. The maximum width of the peel-off coating was determined.

(B) Adhesion test:

The coated plate was dipped in deionized water at 40° C. for 20 days, after which it was provided with grids (100 squared each) made at 1 mm intervals and at 2 mm intervals using a sharp cutter. To each surface of the thus treated plate, an adhesive tape was applied, after which it was peeled off and the number of the remaining coated squares on the coated plate was counted.

(C) Scab corrosion resistance test:

Cuts were made on the electro-coated plate using a sharp cutter, and thus prepared plate was subjected to 10 test cycles, each cycle consisting of a 5% brine spray test (JIS-Z-2371, 24 hours) a humidity test (temperature 40° C., relative humidity 85%, 120 hours) standing in a room temperature for 24 hours.

(This 10 cycles' test is herein referred to as scab corrosion test) After the test, the average value (mm) of the maximum diameter of abnormal coating (e.g. rust and blisters) was measured.

TABLE 1

| | Ex. 1 | Comp. Ex. 1 | Ex. 2 | Comp. Ex. 2 | Ex. 3 | Ex. 4 |
|---|---|---|---|---|---|---|
| Composition of acidic aqueous phosphate solution | | | | | | |
| Zn ion (g/l) | 0.8 | 0.8 | 1.0 | 1.0 | 1.0 | 1.0 |
| $PO_4$ ion (g/l) | 14.0 | 14.0 | 14.0 | 14.0 | 14.0 | 14.0 |
| Mn ion (g/l) | 0 | 0 | 0.8 | 0.8 | 0.8 | 0.8 |
| Ni ion (g/l) | 0 | 0 | 0.8 | 0.8 | 0.8 | 0.8 |
| F ion (g/l) | 0 | 0 | 0 | 0 | 1.0 | 1.0 |
| $NO_2$ ion (g/l) | 0.15 | 0.15 | 0.15 | 0.15 | 0.12 | 0.12 |
| $NO_3$ ion (g/l) | 3.0 | 3.0 | 4.0 | 4.0 | 4.0 | 4.0 |
| $ClO_3$ ion (g/l) | 0.5 | 0.5 | 0.7 | 0.7 | 0 | 0 |
| Colloidal particles | | | | | | |
| amount g/l | 0.5 | 0 | 1.0 | 0 | 1.0 | 1.0 |
| kind | Snow TexO SiO | | Snow TexO SiO | | Snow TexAK SiO—Al O | Snow TexOS SiO |
| isoelectric point | 2 | | 2 | | 3> | 2 |
| mean diameter | 10~20 mμ | | 10~20 mμ | | 10~20 mμ | 7~9 mμ |
| Total acidity (point) | 17.0 | 16.3 | 18.4 | 18.5 | 22.0 | 22.3 |
| Free acidity (point) | 0.9 | 0.9 | 0.9 | 0.9 | 0.9 | 0.9 |
| treatment temperature (°C.) | 52 | 52 | 52 | 52 | 40 | 40 |
| Process | Dip | Dip | Dip | Dip | Dip | Dip |

| | Comp. Ex. 3 | Comp. Ex. 4 | Ex. 5 | Ex. 6 | Comp. Ex. 5 |
|---|---|---|---|---|---|
| Composition of acidic aqueous phosphate solution | | | | | |
| Zn ion (g/l) | 1.0 | 1.0 | 0.4 | 0.4 | 0.4 |
| $PO_4$ ion (g/l) | 14.0 | 14.0 | 14.5 | 14.5 | 14.5 |
| Mn ion (g/l) | 0.8 | 0.8 | 0 | 0 | 0 |
| Ni ion (g/l) | 0.8 | 0.8 | 0.5 | 0.5 | 0.5 |
| F ion (g/l) | 1.0 | 1.0 | 0 | 0 | 0 |
| $NO_2$ ion (g/l) | 0.12 | 0.12 | 0.1 | 0.1 | 0.1 |
| $NO_3$ ion (g/l) | 4.0 | 4.0 | 7.0 | 7.0 | 7.0 |
| $ClO_3$ ion (g/l) | 0 | 0 | 0.3 | 0.3 | 0.3 |
| Colloidal particles | | | | | |
| amount g/l | 0 | 1.0 | 1.0 | 1.0 | 0 |
| kind | | Alumina Zol 520 $Al_2O_3$ | A-1550 $Sb_2O_5$ | EM1100 acrylic resin particle | |
| isoelectric point | | 4 | 3> | 3> | |
| mean diameter | | 10~20 mμ | 20~50 mμ | 10~20 mμ | |
| Total acidity (point) | 22.0 | 21.9 | 16.8 | 16.5 | 16.4 |
| Free acidity (point) | 0.9 | 0.9 | 0.2 | 0.2 | 0.2 |
| treatment temperature (°C.) | 40 | 40 | 55 | 55 | 55 |
| Process | Dip | Dip | Spray | Spray | Spray |

Snowtex O: trademark, Nissan Kagaku Kogyo K.K.
Snowtex AK: trademark, Nissan Kagaku Kogyo K.K.
Snowtex OS: trademark, Nissan Kagaku Kogyo K.K.
Alumina Zol 520: trademark, Nissan Kagaku Kogyo K.K.
A-1550: trademark, Nissan Kagaku Kogyo K.K.
EM-1100: acrylic resin emulsion prepared by the method of Japanese Patent Publication (unexamined) 43362/86 by Nippon Paint Co., Ltd.

The amounts of colloidal particles were expressed in terms of solid content.

TABLE 2

| Metal | Test Items | Ex. 1 | Comp. Ex. 1 | Ex. 2 | Comp. Ex. 2 | Ex. 3 | Ex. 4 |
|---|---|---|---|---|---|---|---|
| Galvanealed steel plate | Film weight (g/m$^2$) | 4.6 | 4.3 | 3.4 | 3.0 | 3.3 | 3.3 |
| | Adhesion 2 mm | 100/100 | 45/100 | 100/100 | 100/100 | 100/100 | 100/100 |
| | 1 mm | 60/100 | 0/100 | 100/100 | 100/100 | 100/100 | 100/100 |
| | Hot brine resistance (mm) | 3.0 | 5.9 | 2.0 | 3.3 | 1.0 | 0.8 |
| Electro-galvanized steel plate | Film weight (g/m$^2$) | 3.6 | 3.0 | 2.6 | 2.4 | 2.5 | 2.4 |
| | Adhesion 2 mm | 90/100 | 0/100 | 100/100 | 100/100 | 100/100 | 100/100 |
| | 1 mm | 45/100 | 0/100 | 100/100 | 95/100 | 100/100 | 100/100 |
| | Hot brine resistance (mm) | 4.6 | 8.2 | 2.5 | 4.3 | 1.6 | 1.4 |
| Electro-zinc-alloy plated steel plate | Film weight (g/m$^2$) | 4.2 | 4.0 | 3.8 | 3.2 | 2.8 | 2.8 |
| | Adhesion 2 mm | 95/100 | 35/100 | 100/100 | 100/100 | 100/100 | 100/100 |
| | 1 mm | 50/100 | 0/100 | 100/100 | 95/100 | 100/100 | 100/100 |
| | Hot brine resistance (mm) | 2.9 | 6.3 | 1.9 | 4.0 | 1.0 | 0.8 |
| Cold rolled steel plate | Film weight (g/m$^2$) | 3.0 | 2.5 | 2.8 | 2.3 | 2.5 | 2.5 |
| | Adhesion 2 mm | 100/100 | 35/100 | 100/100 | 100/100 | 100/100 | 100/100 |
| | 1 mm | 100/100 | 35/100 | 100/100 | 100/100 | 100/100 | 100/100 |
| | Hot brine resistance (mm) | 1.0 | 3.0 | 0.5 | 1.5 | 0 | 0 |
| | Scab resistance (cutted portion) | 6.2 | 12.5 | 3.5 | 6.5 | 3.0 | 2.8 |

| Metal | Test Items | Comp. Ex. 3 | Comp. Ex. 4 | Ex. 5 | Ex. 6 | Comp. Ex. 5 |
|---|---|---|---|---|---|---|
| Galvanealed steel plate | Film weight (g/m$^2$) | 3.0 | 3.1 | 3.6 | 3.4 | 3.5 |
| | Adhesion 2 mm | 100/100 | 100/100 | 100/100 | 100/100 | 50/100 |
| | 1 mm | 100/100 | 100/100 | 80/100 | 85/100 | 15/100 |
| | Hot brine resistance (mm) | 2.5 | 2.6 | 4.0 | 2.5 | 4.5 |
| Electro-galvanized steel plate | Film weight (g/m$^2$) | 2.0 | 2.2 | 3.5 | 3.4 | 3.0 |
| | Adhesion 2 mm | 100/100 | 100/100 | 95/100 | 100/100 | 0/100 |
| | 1 mm | 100/100 | 100/100 | 60/100 | 80/100 | 0/100 |
| | Hot brine resistance (mm) | 3.6 | 3.7 | 5.0 | 4.5 | 5.4 |
| Electro-zinc-alloy plated steel plate | Film weight (g/m$^2$) | 2.6 | 2.7 | 3.4 | 3.0 | 3.5 |
| | Adhesion 2 mm | 100/100 | 100/100 | 100/100 | 100/100 | 50/100 |
| | 1 mm | 100/100 | 100/100 | 90/100 | 100/100 | 20/100 |
| | Hot brine resistance (mm) | 3.0 | 3.1 | 4.0 | 3.0 | 4.5 |
| Cold rolled steel plate | Film weight (g/m$^2$) | 2.0 | 2.0 | 1.5 | 1.5 | 1.5 |
| | Adhesion 2 mm | 100/100 | 100/100 | 100/100 | 100/100 | 100/100 |
| | 1 mm | 100/100 | 100/100 | 100/100 | 100/100 | 100/100 |
| | Hot brine resistance (mm) | 1.1 | 1.2 | 2.0 | 1.5 | 3.5 |
| | Scab resistance (cutted portion) | 4.6 | 4.8 | 8.5 | 7.0 | 10.5 |

EXAMPLE 7

The similar coated plates were prepared as in Example 1 excepting adding a post-treatment after washing step (e) and before pure water washing step (f), the post-treatment comprising dipping the washed plate into Surflite 41 (chromic post-treating agent, 0.4 wt % content, made by Nippon Paint Co.) at 50° C. for 15 seconds.

Thus obtained coated plates were then subjected to hot brine dip test, adhesion test and scab corrosion test as in Example and the test results were shown in Table 3.

EXAMPLE 8

The similar procedures as stated in Example 7 were repeated excepting substituting Surflite 70AN-1 (zirconium base post-treating agent, 1.0 wt % content, made by Nippon Paint Co.) for Surflite 41.

The test results with thus obtained coated plates were shown in Table 3.

COMPARATIVE EXAMPLE 6

In Comparative Example 1, post-treatment comprising dipping the washed plate in Surflite 41 at 50° C. for 15 seconds was placed in after the washing step (e) and before the pure water washing step (f). Thus obtained coated plated were tested as in Example 7 and the test results were shown in Table 3.

COMPARATIVE EXAMPLE 7

The same procedures as stated in Comparative Example 6 were repeated excepting substituting Surflite 70AN-1 for Surflite 41. The coated plates were tested as in Example 7 and the test results were shown in Table 3.

TABLE 3

| Metal | Test Items | Ex. 7 | Ex. 8 | Comp. Ex. 6 | Comp. Ex. 7 |
|---|---|---|---|---|---|
| Galvanealed steel plate | Film weight (g/m$^2$) | 4.5 | 4.4 | 4.2 | 4.3 |
| | Adhesion 2 mm | 100/100 | 100/100 | 85/100 | 90/100 |
| | 1 mm | 80/100 | 100/100 | 50/100 | 60/100 |

TABLE 3-continued

| Metal | Test Items | Ex. 7 | Ex. 8 | Comp. Ex. 6 | Comp. Ex. 7 |
|---|---|---|---|---|---|
| | Hot brine resistance (mm) | 2.5 | 2.0 | 3.5 | 3.8 |
| Electro-galvanized steel plate | Film weight (g/m$^2$) | 3.5 | 3.5 | 2.9 | 2.9 |
| | Adhesion 2 mm | 100/100 | 100/100 | 80/100 | 90/100 |
| | 1 mm | 80/100 | 100/100 | 40/100 | 95/100 |
| | Hot brine resistance (mm) | 3.5 | 2.3 | 4.8 | 5.0 |
| Electro-zinc-alloy plated steel plate | Film weight (g/m$^2$) | 4.1 | 4.1 | 3.9 | 3.9 |
| | Adhesion 2 mm | 100/100 | 100/100 | 90/100 | 90/100 |
| | 1 mm | 85/100 | 100/100 | 50/100 | 55/100 |
| | Hot brine resistance (mm) | 2.4 | 1.5 | 3.6 | 3.8 |
| Cold rolled steel plate | Film weight (g/m$^2$) | 3.0 | 2.9 | 2.5 | 2.5 |
| | Adhesion 2 mm | 100/100 | 100/100 | 100/100 | 100/100 |
| | 1 mm | 100/100 | 100/100 | 100/100 | 100/100 |
| | Hot brine resistance (mm) | 0.8 | 0.5 | 1.8 | 2.0 |
| | Scab resistance (cutted portion) | 5.4 | 4.0 | 8.0 | 6.5 |

What is claimed is:

1. A process for forming a phosphate on a metal surface, which is suitable for cationic electrocoating, comprising treating the metal surface with an acid aqueous phosphate solution having a PH of 3 to about 4 comprising:

(a) from 0.1 to 2.0 g/l of zinc ions, (b) form 5 to 40 g/l of phosphate ions, (c) a phosphating accelerator selected from the group consisting of (i) from 0.01 to 0.5 g/l of nitrite ions, (ii) from 0.05 to 5 g/l of m-nitrobenzene sulfonate ions, and (iii) from 0.5 to 10 g/l of hydrogen peroxide based on 100% $H_2O_2$, (d) from 0.1 to 3 g/l of manganese ions, (e) from 0.1 to 6 g/l of nickel ions, and (f) from 0.01 to 10 g/l of colloidal particles having an isoelectric point of 3 or less and an average particle diameter of 0.1 μm or less.

2. A process according to claim 1, wherein the colloidal particles are selected from the group consisting of at least one of the following (i) silica particles (ii) silica-alumina particles (iii) silica-titania particles (iv) silica-zirconia particles (v) antimony oxide particles, and (vi) acrylic resin particles.

3. A process according to claim 1, wherein the acidic aqueous phosphate solution further contains up to 4 g/l of fluoride ion.

4. A process according to claim 1, wherein the acidic aqueous phosphate solution further contains up to 15 g/l of nitrate ion and/or less than 2 g/l of chlorate ion.

5. A process according to claim 1, wherein the treatment is carried out at a temperature of 20°~70° C.

6. A process according to claim 1, wherein the metal surface includes an iron-based surface, a zinc based surface or a combination of iron-based surface and zinc-based surface.

* * * * *